US012426767B2

(12) United States Patent
Cheng et al.

(10) Patent No.: US 12,426,767 B2
(45) Date of Patent: Sep. 30, 2025

(54) CONTROL METHOD FOR DISHWASHER AND DISHWASHER

(71) Applicants: FOSHAN SHUNDE MIDEA WASHING APPLIANCES MANUFACTURING CO., LTD., Guangdong (CN); MIDEA GROUP CO., LTD., Guangdong (CN)

(72) Inventors: Yahui Cheng, Guangdong (CN); Hyoungjun Kim, Guangdong (CN); Shaohe Qu, Guangdong (CN); Yajun Yi, Guangdong (CN); Liuguang Zhang, Guangdong (CN); Hui Kong, Guangdong (CN)

(73) Assignees: FOSHAN SHUNDE MIDEA WASHING APPLIANCES MANUFACTURING CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/205,738

(22) Filed: Jun. 5, 2023

(65) Prior Publication Data

US 2023/0301483 A1 Sep. 28, 2023

Related U.S. Application Data

(63) Continuation of application No. PCT/CN2021/112736, filed on Aug. 16, 2021.

(30) Foreign Application Priority Data

Dec. 4, 2020 (CN) ..... 202011413490.X

(51) Int. Cl.
*A47L 15/00* (2006.01)
*A47L 15/18* (2006.01)
(Continued)

(52) U.S. Cl.
CPC ..... *A47L 15/0018* (2013.01); *A47L 15/22* (2013.01); *A47L 15/18* (2013.01); *A47L 15/20* (2013.01);
(Continued)

(58) Field of Classification Search
None
See application file for complete search history.

(56) References Cited

U.S. PATENT DOCUMENTS

2014/0069462 A1* 3/2014 Becker ..... A47L 15/4219 134/10
2014/0246059 A1 9/2014 Feddema
2019/0099054 A1* 4/2019 Digman ..... A47L 15/507

FOREIGN PATENT DOCUMENTS

CN 106028894 A 10/2016
CN 106419794 A 2/2017
(Continued)

OTHER PUBLICATIONS

International Search Report dated Oct. 14, 2021 issued in PCT/CN2021/112736.
First Office Action dated Jun. 26, 2023 received in Chinese Patent Application No. CN 202011413490.X.
Written Opinion of the International Searching Authority dated Oct. 14, 2021 received in International Application No. PCT/CN2021/112736.
(Continued)

*Primary Examiner* — Kaj K Olsen
*Assistant Examiner* — Richard Z. Zhang
(74) *Attorney, Agent, or Firm* — Scully, Scott, Murphy & Presser, P.C.

(57) ABSTRACT

Provided are a control method for a dishwasher and a dishwasher. The dishwasher includes a spray rod and a spray rod driver configured to drive the spray rod to rotate. The control method for the dishwasher includes acquiring a predetermined washing signal; controlling the spray rod driver to drive the spray rod to rotate into a predetermined washing region from a current position; and adjusting a
(Continued)

parameter of sprayed fluid flow when the spray rod rotates into the predetermined washing region.

8 Claims, 6 Drawing Sheets

(51) Int. Cl.
*A47L 15/20* (2006.01)
*A47L 15/22* (2006.01)
*A47L 15/42* (2006.01)

(52) U.S. Cl.
CPC ..... *A47L 2401/14* (2013.01); *A47L 2401/24* (2013.01); *A47L 2501/04* (2013.01); *A47L 2501/20* (2013.01)

(56) References Cited

FOREIGN PATENT DOCUMENTS

| | | | | |
|---|---|---|---|---|
| CN | 106618429 | A | | 5/2017 |
| CN | 109316151 | A | * | 2/2019 |
| CN | 110623613 | A | | 12/2019 |
| CN | 111631657 | A | | 9/2020 |
| CN | 112716409 | A | | 4/2021 |
| CN | 113040681 | A | | 6/2021 |

OTHER PUBLICATIONS

Second Office Action dated Mar. 13, 2024 received in Chinese Patent Application No. CN 202011413490.X.

Rejection Decision dated May 27, 2024 received in Chinese Patent Application No. CN 202011413490.X.

* cited by examiner

CONTROL METHOD FOR DISHWASHER AND DISHWASHER

CROSS-REFERENCE TO RELATED APPLICATIONS

The present application is a continuation application of PCT International Application No. PCT/CN2021/112736, filed on Aug. 16, 2021, which claims priority to and benefits of Chinese Patent Application No. 202011413490.X, filed on Dec. 4, 2020, the entire disclosure of each of which is incorporated herein by reference for all purposes. No new matter has been introduced.

FIELD

The present disclosure relates to the field of washing device technologies, and more particularly, to a control method for a dishwasher and a dishwasher.

BACKGROUND

In the related art, a dishwasher has a constant washing fluid pressure and a single washing mode. As a result, it is difficult to set different washing fluid pressures for the for the dishwasher system based on types of tableware in different regions to perform predetermined washing on the tableware in a predetermined region, which leads to an inconsistent washing effect.

SUMMARY

The present disclosure aims to solve at least one of the technical problems in the related art. To this end, according to some embodiments of the present disclosure, there is provided a control method for a dishwasher, which is capable of changing a fluid flow parameter when a spray rod of the dishwasher rotates into a predetermined washing region to clean tableware in the predetermined washing region.

According to some embodiments of the present disclosure, there is also provided a dishwasher.

According to embodiments of the present disclosure, there is provided a control method for a dishwasher. The dishwasher includes a spray rod and a spray rod driver configured to drive the spray rod to rotate. The control method includes: acquiring a predetermined washing signal; controlling the spray rod driver to drive the spray rod to rotate into a predetermined washing region from a current position; and adjusting a parameter of sprayed fluid flow when the spray rod rotates into the predetermined washing region.

In the control method for the dishwasher, after the predetermined signal is received, the spray rod is controlled to rotate into the predetermined washing region from the current position, and the parameter of the fluid flow is changed when the spray rod rotates into the predetermined washing region. Therefore, a predetermined washing can be performed on tableware in the predetermined washing region. In this way, washing efficiency and washing effect can be improved to allow diverse washing modes.

According to some embodiments of the present disclosure, the controlling the spray rod driver to drive the spray rod to rotate into the predetermined washing region from the current position includes: controlling the spray rod driver to drive the spray rod to directly rotate into the predetermined washing region from the current position.

In some embodiments, the control method for the dishwasher further includes, prior to the controlling the spray rod driver to drive the spray rod to directly rotate into the predetermined washing region from the current position: calculating a duration required for the spray rod driver to drive the spray rod to rotate into the predetermined washing region from the current position.

In some other embodiments, the spray rod driver includes a motor, and the motor is a bidirectional rotary motor. The method further includes, prior to the controlling the spray rod driver to drive the spray rod to directly rotate into the predetermined washing region from the current position: detecting an angle between the current position and each of two boundary lines of the predetermined washing region; and calculating, based on the detection, a duration required for the motor to drive the spray rod to rotate from the current position to a closer one of the two boundary lines to the spray rod, to control the motor to drive the spray rod to rotate towards the closer one of the two boundary lines to the spray rod.

According to some other embodiments of the present disclosure, the controlling the spray rod driver to drive the spray rod to rotate into the predetermined washing region from the current position includes: controlling the spray rod driver to drive the spray rod to rotate into an initial position from the current position; and controlling the spray rod driver to drive the spray rod to rotate into the predetermined washing region from the initial position.

In some embodiments, the control method for the dishwasher further includes, prior to the controlling the spray rod driver to drive the spray rod to rotate into the initial position from the current position: calculating a duration required for the spray rod driver to drive the spray rod to rotate into the initial position from the current position.

In some other embodiments, the spray rod driver includes a motor, and the motor is a bidirectional rotary motor. The method further includes, prior to the controlling the spray rod driver to drive the spray rod to rotate into the initial position from the current position: detecting an angle between the current position and the initial position in a first rotation direction; calculating, in response to determining that the angle is greater than 180°, a duration required for the motor to drive the spray rod to rotate into the initial position from the current position in a second rotation direction opposite to the first rotation direction; and calculating, in response to determining that the angle is smaller than or equal to 180°, a duration required for the motor to drive the spray rod to rotate into the initial position from the current position in the first rotation direction.

In some embodiments, the spray rod driver includes a motor and a transmission mechanism. The spray rod is in transmission connection to a shaft of the motor through the transmission mechanism. The method further includes, prior to the controlling the spray rod driver to drive the spray rod to rotate into the predetermined washing region from the initial position: acquiring an actual duration required for the motor to rotate through one revolution; calculating, based on the actual time required for the motor to rotate through one revolution, a duration required for the spray rod to rotate into the predetermined washing region from the initial position.

In some examples, the duration t required for the spray rod to rotate into the predetermined washing region from the initial position is $TN\alpha/360$, where T represents the actual duration required for the motor to rotate through one revolution, a represents an angle between the predetermined washing region and the initial position, and N represents a transmission ratio of the transmission mechanism.

In some examples, the acquiring the actual duration required for the motor to rotate through one revolution includes: detecting a position signal of the motor within a predetermined time period; and obtaining the actual duration required for the shaft of the motor to rotate through one revolution by calculating an interval time between receptions of two same predetermined position signals of the motor within the predetermined time period and a revolution number of the shaft of the motor within the interval time. The predetermined time period is greater than or equal to a rated duration required for the shaft of the motor to rotate through two revolutions.

According to some embodiments of the present disclosure, the control method for the dishwasher further includes: controlling the spray rod driver to drive the spray rod to rotate back and forth or intermittently within a predetermined angle range in the predetermined washing region.

According to some further embodiments of the present disclosure, the control method for the dishwasher further includes, prior to the controlling the spray rod driver to drive the spray rod to rotate into the predetermined washing region from the initial position: calculating a rotation duration of the spray rod in the predetermined washing region to maintain the spray rod at the adjusted parameter of the fluid flow within the rotation duration.

According to some embodiments of the present disclosure, the adjusting the parameter of the sprayed fluid flow when the spray rod rotates into the predetermined washing region includes: increasing or decreasing the parameter of the fluid flow sprayed from the spray rod.

According to embodiments of the present disclosure, there is provided a dishwasher including a rotatable spray rod, a spray rod driver configured to drive the spray rod to rotate, an acquiring device configured to acquire a predetermined washing signal, an adjustment device configured to adjust a parameter of a fluid flow sprayed from the spray rod, and a control device in communication with the spray rod driver, the acquiring device, and the adjustment device. The control device is configured to adjust the parameter of the fluid flow sprayed from the spray rod by means of the adjustment device when the spray rod moves into a predetermined washing region from a current position.

In the dishwasher according to the embodiment of the present disclosure, after the predetermined signal is received by the acquiring device, the spray driver is controlled by the control device to rotate the spray rod into the predetermined washing region from the current position, and the parameter of the fluid flow is changed by means of the adjustment device when the spray rod rotates into the predetermined washing region. Therefore, a predetermined washing can be performed on tableware in the predetermined washing region. In this way, washing efficiency and washing effect can be improved to allow diverse washing modes.

According to some embodiments of the present disclosure, the control device is further configured to control the spray rod driver to drive the spray rod to directly rotate into the predetermined washing region from the current position.

According to some other embodiments of the present disclosure, the control device is further configured to control the spray rod driver to drive the spray rod to rotate into an initial position from the current position, and control the spray rod driver to drive the spray rod to rotate into the predetermined washing region from the initial position.

In some embodiments, the spray rod driver includes a motor and a transmission mechanism. The spray rod is in transmission connection to a shaft of the motor through the transmission mechanism. The dishwasher further includes a calculation device configured to calculate, based on an actual duration required for the motor to rotate through one revolution, a duration required for the spray rod to rotate into the predetermined washing region from the initial position.

In some examples, the duration t required for the spray rod to rotate into the predetermined washing region from the initial position is $TN\alpha/360$, where T represents the actual duration required for the motor to rotate through one revolution, a represents an angle between the predetermined washing region and the initial position, and N represents a transmission ratio of the transmission mechanism.

In some examples, the dishwasher further includes a position detection device in communication with the control device. The position detection device is configured to detect a position signal of the motor within a predetermined time period. The calculation device is further configured to obtain the actual duration required for the shaft of the motor to rotate through one revolution by calculating an interval time between receptions of two same predetermined position signals of the motor within the predetermined time period and a revolution number of the shaft of the motor within the interval time. The predetermined time period is greater than or equal to a rated duration required for the shaft of the motor to rotate through two revolutions.

Additional aspects and advantages of the embodiments of present disclosure will be provided at least in part in the following description, or will become apparent in part from the following description, or can be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

Figure 1:
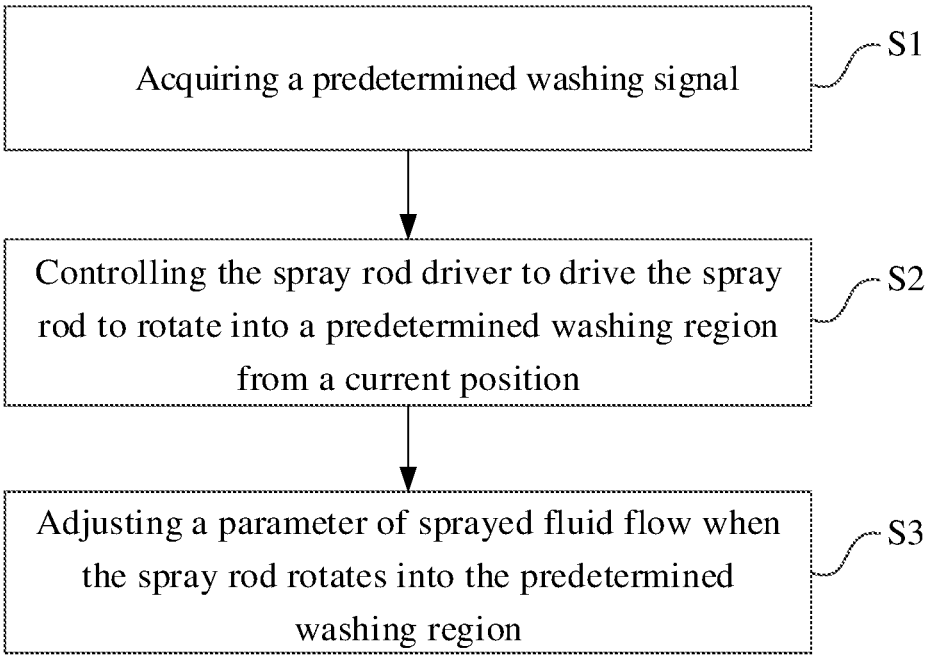
FIG. 1 is a flowchart of a control method for a dishwasher according to embodiments of the present disclosure.

Reference numerals are listed as follows:

dishwasher 100, inner tub 10, spray rod 20, spray rod driver 30, motor 31, transmission mechanism 32, protrusion 33, position detection device 40.

DETAILED DESCRIPTION

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain rather than limit the present disclosure.

A control method for a dishwasher and a dishwasher according to embodiments of the present disclosure will be described below with reference to FIG. 1 to FIG. 10.

The dishwasher according to the embodiments of the present disclosure includes a spray rod and a spray rod driver configured to drive the spray rod to rotate. One or more spray rods may be provided.

As illustrated in FIG. 1, the control method for the dishwasher according to the embodiment of the present disclosure includes operations at steps S1 to S3.

At step S1, a predetermined washing signal is acquired.

At step S2, the spray rod driver is controlled to drive the spray rod to rotate into a predetermined washing region from a current position.

At step S3, a parameter of a sprayed fluid flow is adjusted when the spray rod rotates into the predetermined washing region.

In the control method for the dishwasher according to the embodiments of the present disclosure, in response to receiving the predetermined signal, the spray rod is controlled to rotate into the predetermined washing region from the current position, and the parameter of the fluid flow is changed when the spray rod rotates into the predetermined washing region. Therefore, a predetermined washing can be performed on tableware in the predetermined washing region. In this way, washing efficiency and washing effect can be improved to allow diverse washing modes.

The parameter of the fluid flow includes a fluid flow pressure and/or a fluid flow temperature. Adjusting the parameter of the sprayed fluid flow when the spray rod rotates into the predetermined washing region includes increasing or decreasing the parameter of the fluid flow sprayed from the spray rod. In some embodiments, the pressure of the fluid flow sprayed from the spray rod may be increased or reduced as desired, and a temperature of the fluid flow sprayed from the spray rod may also be increased or reduced.

For example, the tableware required for the predetermined washing may be placed in the predetermined washing region by a user based on washing requirement. For example, tableware with a great depth and a complex structure may be placed in the predetermined washing region, and it is desirable to achieve washing in the predetermined region at a great flow rate and a high pressure with a great impact force. Fragile tableware with a relatively thin thickness may also be placed in the predetermined region, and it is desirable to achieve washing in the predetermined region with a small flow rate and a low pressure with a small impact force.

Figure 3:
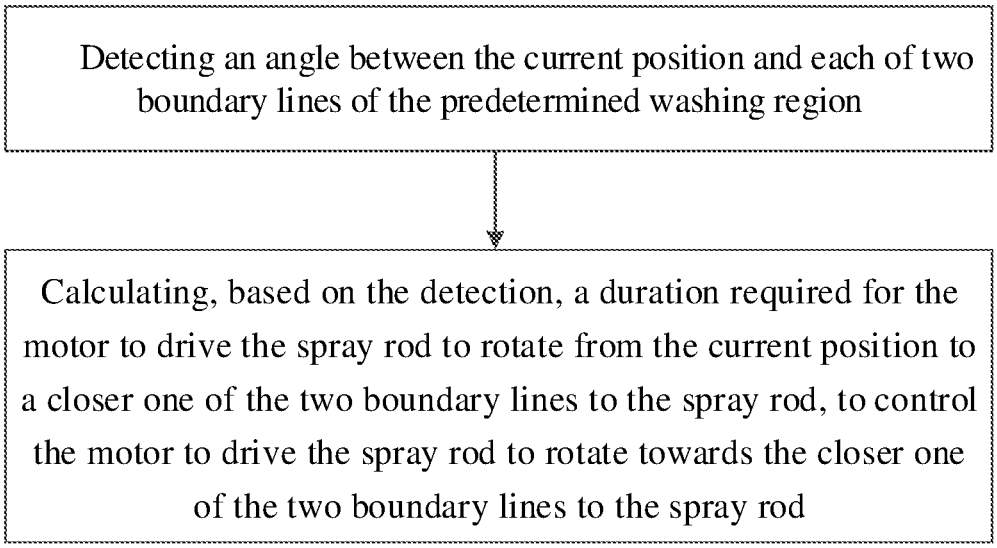
FIG. 3 is a flowchart of step S2 in FIG. 2.

As illustrated in FIG. 3, according to some embodiments of the present disclosure, the controlling the spray rod driver to drive the spray rod to rotate into the predetermined washing region from the current position at block S2 includes: controlling the spray rod driver to drive the spray rod to directly rotate into the predetermined washing region from the current position. That is, in response to acquiring the predetermined washing signal by the system, the spray rod driver is controlled to drive the spray rod to directly rotate into the predetermined washing region from the current position without an intermediate stop.

In some embodiments, the method further includes, prior to controlling the spray rod driver to drive the spray rod to directly rotate into the predetermined washing region from the current position: calculating a duration required for a motor to drive the spray rod to rotate into the predetermined washing region from the current position.

In some embodiments, when the motor is a unidirectional rotary motor, a shaft of the motor is only rotatable in one direction (clockwise or counterclockwise). That is, the motor can only drive the spray rod to rotate towards the predetermined washing region from the current position in one direction. Therefore, the motor can be accurately controlled by calculating the duration required for the motor to drive the spray rod to rotate into the predetermined washing region from the current position in one direction. Thus, the predetermined washing can be performed on the tableware in the predetermined washing region. In this way, the washing efficiency and the washing effect can be improved.

When the motor is a bidirectional rotary motor, the shaft of the motor is rotatable clockwise or counterclockwise. Therefore, a rotation direction of the motor can be controlled by calculating a shortest duration required for the motor to drive the spray rod to rotate into the predetermined washing region from the current position. Thus, the predetermined washing can be performed on the tableware in the predetermined washing region. In this way, the washing efficiency and the washing effect can be improved.

Figure 2:
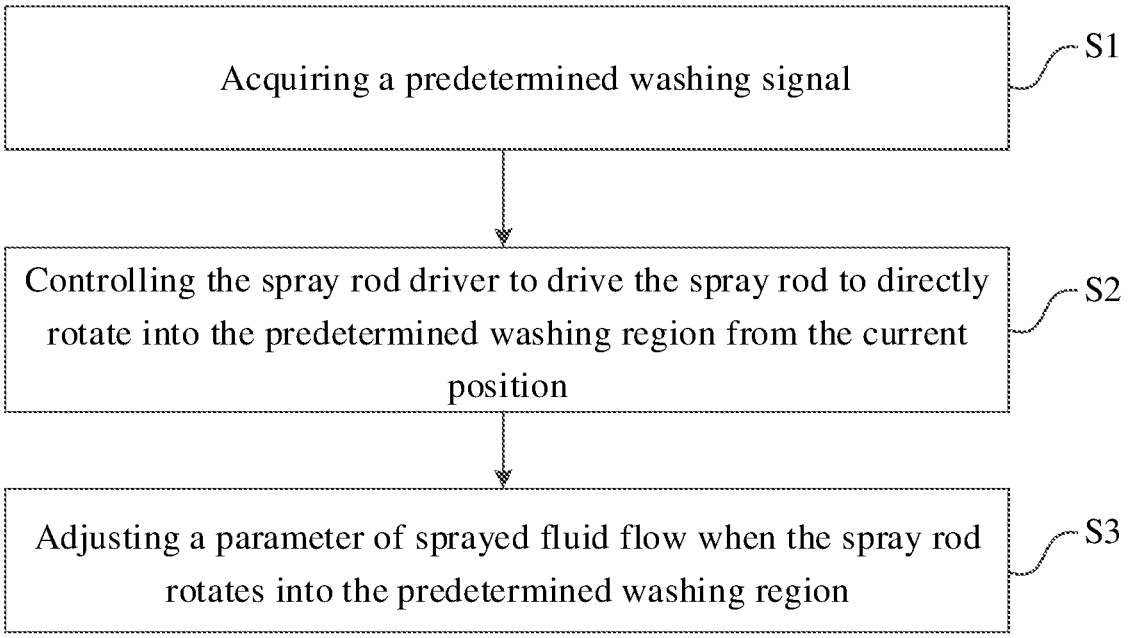
FIG. 2 is a flowchart of a control method for a dishwasher according to an embodiment of the present disclosure.

As illustrated in FIG. 2 and FIG. 3, in some other embodiments, the spray rod driver includes a motor, and the motor is a bidirectional rotary motor. The method further includes, prior to controlling the spray rod driver to drive the spray rod to directly rotate into the predetermined washing region from the current position: detecting an angle between the current position and each of two boundary lines of the predetermined washing region; and calculating, based on the detection, a duration required for the motor to drive the spray rod to rotate from the current position to a closer one of the two boundary lines to the spray rod, to control the motor to drive the spray rod to rotate towards the closer one of the two boundary lines to the spray rod.

In this embodiment, the motor is the bidirectional rotary motor, i.e., the shaft of the motor is rotatable clockwise or counterclockwise. Thus, in order to improve the operating efficiency and reduce the duration required for the spray rod to rotate into the predetermined washing region, before the spray rod is driven by the motor to directly rotate into the predetermined washing region from the current position, the angle between the current position where the spray rod is positioned and each of two boundary lines of the predetermined washing region can be detected first to determine the closer one of the two boundary lines to the spray rod, and then the duration required for the motor to drive the spray rod to rotate towards the closer one of the two boundary lines to the spray rod is calculated based on the determination to achieve an accurate control.

Figure 4:
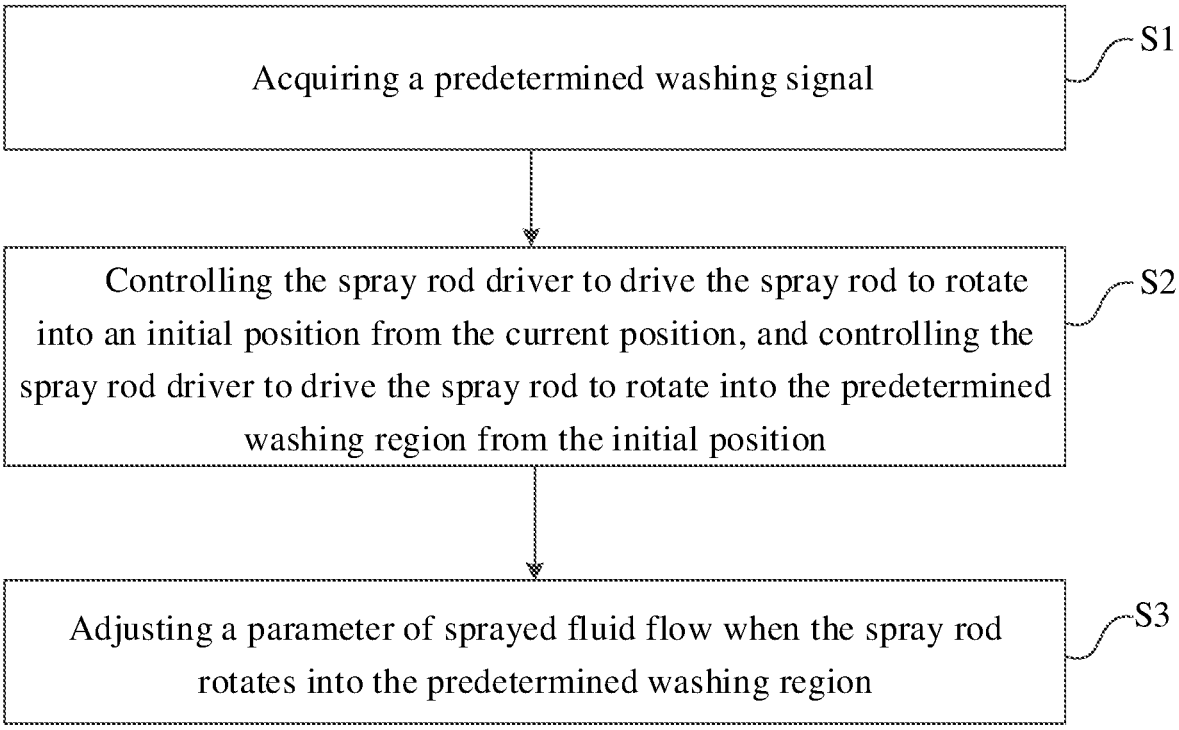
FIG. 4 is a flowchart of a control method for a dishwasher according to another embodiment of the present disclosure.

As illustrated in FIG. 4, according to some other embodiments of the present disclosure, the controlling the spray rod driver to drive the spray rod to rotate into the predetermined washing region from the current position at step S2 includes: controlling the spray rod driver to drive the spray rod to rotate into an initial position from the current position; and controlling the spray rod driver to drive the spray rod to rotate into the predetermined washing region from the initial position.

That is, in response to acquiring the predetermined washing signal by the system, the spray rod driver is first controlled to drive the spray rod to directly rotate into the initial position from the current position, and the spray rod driver is then controlled to drive the spray rod to rotate into the predetermined washing region from the initial position. In this way, a segmented control over the rotation of the spray rod can be realized.

In some embodiments, the method further includes, prior to controlling the spray rod driver to drive the spray rod to rotate into the initial position from the current position: calculating a duration required for the motor to drive the spray rod to rotate into the initial position from the current position.

In this embodiment, when the motor is a unidirectional rotary motor, the shaft of the motor is only rotatable in one direction (clockwise or counterclockwise). That is, the motor can only drive the spray rod to rotate towards the initial position from the current position in one direction. Therefore, the motor can be accurately controlled by calculating the duration required for the motor to drive the spray rod to rotate into the initial position from the current position in one direction.

When the motor is a bidirectional rotary motor, the shaft of the motor is rotatable clockwise or counterclockwise. Therefore, the rotation direction of the motor is controlled by calculating a shortest duration required for the motor to drive the spray rod to rotate into the initial position from the current position. Therefore, the predetermined washing is performed on the tableware in the predetermined washing region while improving the washing efficiency. In this way, the washing efficiency and the washing effect can be improved.

Figure 5:
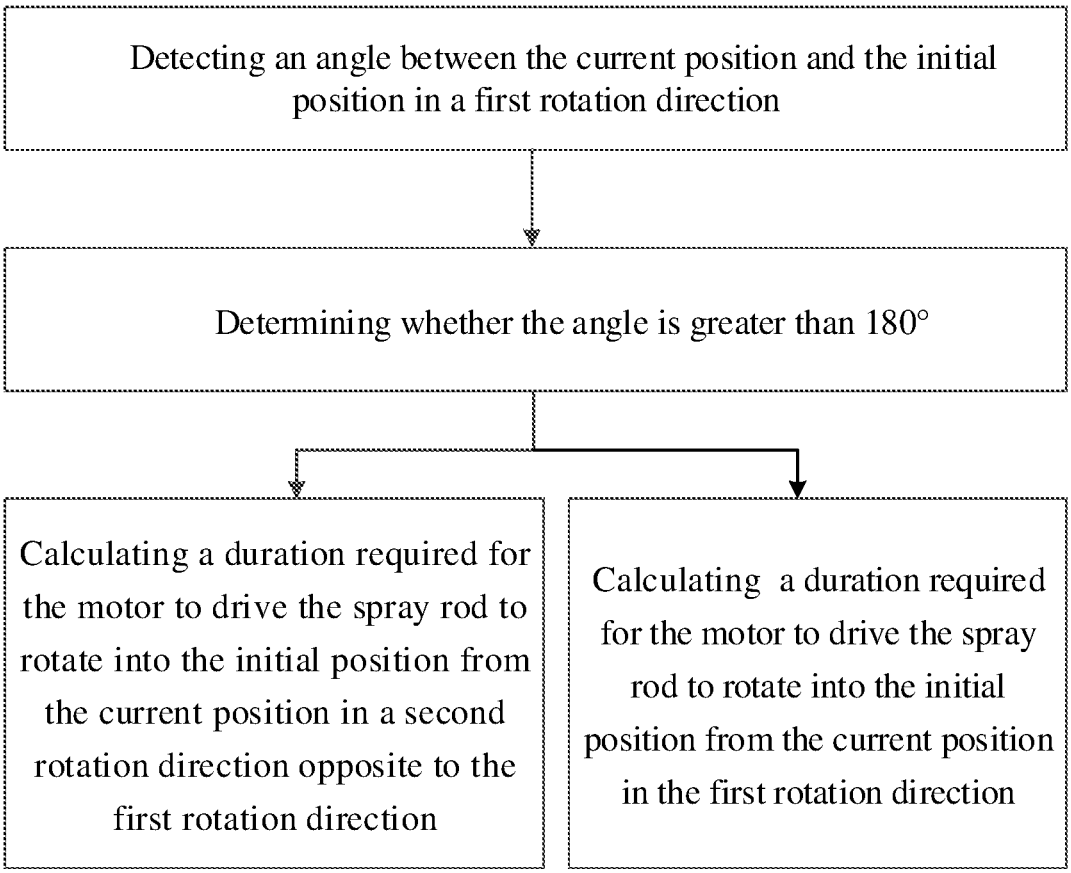
FIG. 5 is a flowchart of step S2 in FIG. 4.

As illustrated in FIG. 4 and FIG. 5, in some other embodiments, the spray rod driver includes a motor, and the motor is a bidirectional rotary motor. The method further includes, prior to controlling the spray rod driver to drive the spray rod to rotate into the initial position from the current position: detecting an angle between the current position and the initial position in a first rotation direction; calculating, in response to determining that the angle is greater than 180°, a duration required for the motor to drive the spray rod to rotate into the initial position from the current position in a second rotation direction opposite to the first rotation direction; and calculating, in response to determining that the angle is smaller than or equal to 180°, a duration required for the motor to drive the spray rod to rotate into the initial position from the current position in the first rotation direction.

The first rotation direction herein may be the clockwise direction, and the second rotation direction is the counterclockwise direction correspondingly. The first rotation direction may also be the counterclockwise direction, and the second rotation direction is the clockwise direction correspondingly.

In some embodiments, the motor is the bidirectional rotary motor, i.e., the shaft of the motor is rotatable clockwise or counterclockwise. Thus, in order to improve the operating efficiency and reduce the duration required for the spray rod to rotate into the initial position, before the spray rod is driven by the motor to directly rotate into the initial position from the current position, the angle between the current position where the spray rod is positioned and the initial position in the first rotation direction can be detected first to determine the rotation direction of the spray rod based on the detection, and then the shortest duration required for the motor to drive the spray rod to rotate towards the initial position is calculated. In this way, the accurate control can be realized.

In some embodiments, the spray rod driver includes a motor and a transmission mechanism. The spray rod is in transmission connection to a shaft of the motor through the transmission mechanism.

Figure 6:
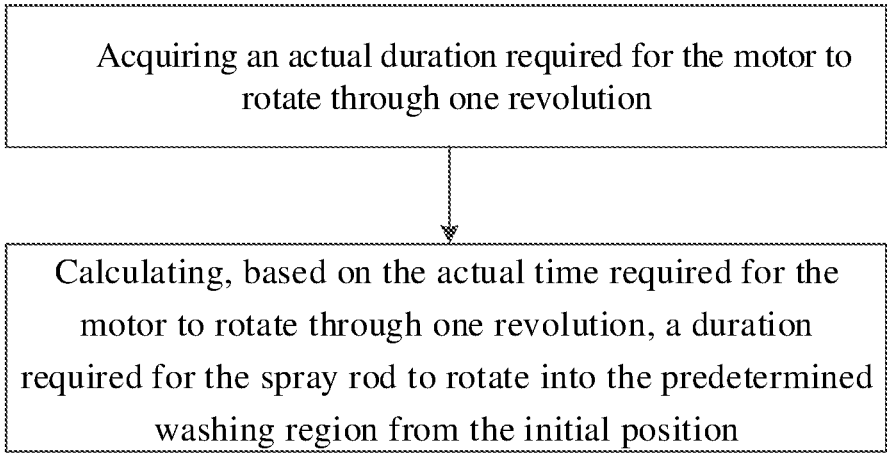
FIG. 6 is a flowchart of step S2 in FIG. 4.

As illustrated in FIG. 4 and FIG. 6, the method further includes, prior to controlling the spray rod driver to drive the spray rod to rotate into the predetermined washing region from the initial position: acquiring an actual duration required for the motor to rotate through one revolution; calculating, based on the actual time required for the motor to rotate through one revolution, a duration required for the spray rod to rotate into the predetermined washing region from the initial position.

In this embodiment, a transmission ratio between the shaft of the motor and the spray rod is known. That is, a transmission ratio of the transmission mechanism is known. A calculation device can calculate, based on the actual duration required for the motor to rotate through one revolution, the duration required for the spray rod to rotate through one revolution, and then calculate, based on a relative relationship between the predetermined washing region and the initial position, the duration required for the spray rod to rotate into the predetermined washing region from the initial position, i.e., the duration required for the motor to operate when the spray rod rotates into the predetermined washing region from the initial position.

In some embodiments, the duration t required for the spray rod to rotate into the predetermined washing region from the initial position is $TN\alpha/360$, where T represents the actual duration required for the motor to rotate through one revolution, a represents an angle between the predetermined washing region and the initial position, and N represents the transmission ratio of the transmission mechanism.

For example, when the transmission ratio of the transmission mechanism is 1:1, the actual duration required for the motor to rotate through one revolution is the duration required for the spray rod to rotate through one revolution, and the duration t required for the spray rod to rotate into the predetermined washing region from the initial position is $TN\alpha/360$.

In some embodiments, the acquiring the actual duration required for the motor to rotate through one revolution includes: detecting a position signal of the motor within a predetermined time period; and obtaining the actual duration required for the shaft of the motor to rotate through one revolution by calculating an interval time between receptions of two same predetermined position signals of the motor within the predetermined time period and a revolution number of the shaft of the motor within the interval time. The predetermined time period is greater than or equal to a rated duration required for the shaft of the motor to rotate through two revolutions.

Therefore, the actual duration required for the shaft of the motor to rotate through one revolution is obtained by calculating the interval time between receptions of the two same predetermined position signals of the motor within the predetermined time period and the revolution number of the shaft of the motor within the interval time. Thus, a washing pump can be easily controlled later. As a result, after receiving the predetermined washing signal, the spray rod is controlled to rotate into the predetermined washing region from the current position, and the parameter of the fluid flow, such as the fluid flow pressure and/or the fluid flow temperature, is changed when the spray rod rotates into the predetermined washing region. Therefore, the predetermined washing can be performed on the tableware in the predetermined washing region. In this way, the washing efficiency and the washing effect can be improved to allow the diverse washing modes.

The interval time between the two same predetermined position signals is equal to an interval time between two same adjacent position signals, or is an integer multiple of the interval time between the two same adjacent position signals.

In other embodiments, the spray rod driver includes a motor, and the motor is a bidirectional rotary motor. The method further includes, prior to controlling the spray rod driver to drive the spray rod to rotate into the predetermined washing region from the initial position: detecting an angle between the current position and each of two boundary lines of the predetermined washing region; and calculating, based on the detection, a duration required for the motor to drive the spray rod to rotate from the current position to one of the two boundary lines closer to the spray rod, to control the motor to drive the spray rod to rotate towards the closer one of the two boundary lines to the spray rod.

In this embodiment, the motor is a bidirectional rotary motor. That is, the shaft of the motor is rotatable clockwise or counterclockwise. Thus, in order to improve the operating efficiency and reduce the duration required for the spray rod rotates into the predetermined washing region, before the spray rod is driven by the motor to directly rotate into the predetermined washing region from the initial position, the angle between the initial position and each of two boundary lines of the predetermined washing region can be detected first to determine the closer one of the two boundary lines to the spray rod, and then the duration required for the motor to drive the spray rod to rotate towards the closer one of the two boundary lines to the spray rod is calculated based on the determination. In this way, the accurate control can be realized.

According to some embodiments of the present disclosure, the spray rod driver is controlled to drive the spray rod to rotate back and forth within a predetermined angle range in the predetermined washing region.

That is, when the spray rod is driven by the spray rod driver to rotate into the predetermined washing region, the spray rod may be subsequently controlled to rotate back and forth in the predetermined washing region. For example, the spray rod may be controlled to rotate back and forth five times in a designated region of the predetermined washing region, then rotate back and forth a plurality of times in another designated region of predetermined washing region, and rotate out of the predetermined washing region to wash other remaining tableware. In this way, the tableware in the predetermined washing region can be repeatedly washed. As a result, it is possible to improve cleanliness of the tableware being washed in the predetermined washing region.

According to some other embodiments of the present disclosure, the spray rod driver is controlled to drive the spray rod to intermittently rotate within a predetermined angle range in the predetermined washing region.

For example, the spray rod driver can drive the spray rod to rotate back and forth within the predetermined angle range in the predetermined washing region to repeatedly wash the tableware in the predetermined washing region. Then, the spray rod is controlled to stop rotating to allow detergent or a fluid to fully permeate stubborn stain on the tableware. The spray rod is then controlled to rotate back and forth to further repeatedly wash the stain. In this way, the cleanliness of the tableware being washed can be improved.

According to some other embodiments of the present disclosure, the method further includes, prior to controlling the spray rod driver to drive the spray rod to rotate into the predetermined washing region from the initial position: calculating a rotation duration of the spray rod in the predetermined washing region to maintain the spray rod at the adjusted parameter of the fluid flow within the rotation duration.

In this embodiment, an angle between a connecting line between one of the two boundary lines of the predetermined washing region and a center of an inner tub and a connecting line between the other one of the two boundary lines of the predetermined washing region and the center of the inner tub is $\beta-\alpha$, where a is an angle between one of the two boundary lines of the predetermined washing region and the initial position, and $\beta$ is an angle between the other one of the two boundary lines of the predetermined washing region and the initial position. The rotation duration of the spray rod in the predetermined washing region can be calculated as $T(\beta-\alpha)/360$ based on the above formula. Therefore, the washing pump is controlled to maintain the fluid flow pressure in the time period, and recover the initial fluid flow parameter beyond the time period. Thus, the predetermined washing can be performed on the tableware in the predetermined washing region.

A dishwasher 100 according to embodiments of the present disclosure will be described below with reference to the accompanying drawings.

As illustrated in FIG. 7 to FIG. 10, the dishwasher 100 according to the embodiments of the present disclosure includes a rotatable spray rod 20, a spray rod driver 30, and an adjustment device.

One or more spray rod 20 may be provided. The spray rod driver 30 is configured to drive the spray rod 20 to rotate. The adjustment device is configured to adjust a fluid flow parameter sprayed from the spray rod 20. The adjustment device herein may be a washing pump in communication with the spray rod 20. The washing pump is configured to supply a fluid to the spray rod 20 during the rotation of the spray rod 20 to wash different regions. The adjustment device may also be a heater.

The dishwasher 100 may further include an acquiring device and a control device. The acquiring device is configured to acquire a predetermined washing signal. The control device is in communication with the spray rod driver, the acquiring device, and the adjustment device. The control device is configured to adjust the parameter of the fluid flow sprayed from the spray rod 20 by means of the adjustment device when the spray rod moves into a predetermined washing region from a current position. For example, a pressure of the fluid flow sprayed from the spray rod 20 may be adjusted by changing a rotation speed of the washing pump. A temperature of the fluid flow sprayed from the spray rod 20 may also be adjusted by changing heating power of the heater.

In this embodiment, tableware required for the predetermined washing may be placed in the predetermined washing region by a user based on washing requirement. For example, tableware with a great depth and a complex structure may be placed in the predetermined washing region, and it is desirable to achieve washing in the predetermined region at a great flow rate and a high pressure with a great impact force. Fragile tableware with a relatively thin thickness may also be placed in the predetermined region, and it is desirable to achieve washing in the predetermined region with a small flow rate and a low pressure with a small impact force to avoid the damage to the tableware.

After the tableware is placed by the user, the dishwasher 100 is started up. A predetermined washing signal input from the user or identified by the system is acquired by the acquiring device. The spray rod 20 is driven by the spray rod driver 30 to rotate. The washing pump is controlled by the control device to change the fluid flow pressure when the spray rod rotates into the predetermined washing region. In this way, the predetermined washing is performed on the tableware in the predetermined washing region. When the spray rod 20 rotates out of the predetermined washing region, the washing pump is controlled by the control device to recover to an initial fluid flow pressure.

It should be noted that the dishwasher 100 may include one or more predetermined washing regions, which may be designed as desired.

In the dishwasher 100 according to the embodiments of the present disclosure, after the predetermined signal is received by the acquiring device, the spray rod driver 30 is controlled by the control device to drive the spray rod 20 to rotate into the predetermined washing region from the current position, and the parameter of the fluid flow is changed when the spray rod rotates into the predetermined washing region. Thus, the predetermined washing can be performed on the tableware in the predetermined washing region. In this way, washing efficiency and washing effect can be improved to allow diverse washing modes.

The parameter of the fluid flow includes a fluid flow pressure and/or a fluid flow temperature. Adjusting the parameter of the sprayed fluid flow when the spray rod 20 rotates into the predetermined washing region includes increasing or decreasing the parameter of the fluid flow sprayed from the spray rod 20. In some embodiments, the pressure of the fluid flow sprayed from the spray rod 20 may be increased or reduced as desired, and a temperature of the fluid flow sprayed from the spray rod 20 may also be increased or reduced.

According to some embodiments of the present disclosure, the control device is configured to control the spray rod driver 30 to drive the spray rod 20 to directly rotate into the predetermined washing region from the current position. That is, when the predetermined washing signal is acquired by the system, the spray rod driver 30 is controlled to drive the spray rod 20 to directly rotate into the predetermined washing region from the current position without an intermediate stop.

In some embodiments, before the spray rod driver 30 is controlled by the controlled device to drive the spray rod 20 to directly rotate into the predetermined washing region from the current position, it is necessary for the system to calculate a duration required for a motor 31 to drive the spray rod 20 to rotate into the predetermined washing region from the current position.

In some embodiments, when the motor 31 is a unidirectional rotary motor, a shaft of the motor 31 is only rotatable in one direction (clockwise or counterclockwise). That is, the motor 31 can only drive the spray rod 20 to rotate towards the predetermined washing region from the current position in one direction. Therefore, the motor 31 can be accurately controlled by calculating the duration required for the motor 31 to drive the spray rod 20 to rotate into the predetermined washing region from the current position in one direction. Thus, the predetermined washing can be performed on the tableware in the predetermined washing region. In this way, the washing efficiency and the washing effect can be improved.

When the motor is a bidirectional rotary motor, the shaft of the motor is rotatable clockwise or counterclockwise. Therefore, a rotation direction of the motor can be controlled by calculating a shortest duration required for the motor to drive the spray rod to rotate into the predetermined washing region from the current position. Thus, the predetermined washing can be performed on the tableware in the predetermined washing region. In this way, the washing efficiency and the washing effect can be improved.

In some other embodiments, the spray rod driver 30 includes a motor 31, and the motor 31 is a bidirectional rotary motor. Before the spray rod driver 30 is controlled by the control device to drive the spray rod 20 to directly rotate into the predetermined washing region from the current position, it is necessary for the system to detect an angle between the current position and each of two boundary lines of the predetermined washing region, and a duration required for the motor 31 to drive the spray rod 20 to rotate from the current position to a closer one of the two boundary lines to the spray rod 20 is calculated based on the detection, to control the motor 31 to drive the spray rod 20 to rotate towards the closer one of the two boundary lines to the spray rod 20.

In this embodiment, the motor 31 is the bidirectional rotary motor, i.e., the shaft of the motor 31 is rotatable clockwise or counterclockwise. Thus, in order to improve the operating efficiency and reduce the duration required for the spray rod 20 to rotate into the predetermined washing region, before the spray rod 20 is driven by the motor 31 to directly rotate into the predetermined washing region from the current position, the angle between the current position where the spray rod 20 is positioned and each of two boundary lines of the predetermined washing region can be detected first to determine the closer one of the two boundary lines to the spray rod 20, and then the duration required for the motor 31 to drive the spray rod 20 to rotate towards the closer one of the two boundary lines to the spray rod 20 is calculated based on the determination to achieve an accurate control.

According to some other embodiments of the present disclosure, the control device is configured to control the spray rod driver 30 to drive the spray rod 20 to rotate into an initial position from the current position. The control device is further configured to control the spray rod driver 30 to drive the spray rod 20 to rotate into the predetermined washing region from the initial position.

That is, in response to acquiring the predetermined washing signal by the system, the spray rod driver 30 is first controlled to drive the spray rod 20 to directly rotate into the initial position from the current position, and the spray rod driver 30 is then controlled to drive the spray rod 20 to rotate into the predetermined washing region from the initial position. In this way, a segmented control over the rotation of the spray rod 20 can be realized.

In some embodiments, before the spray rod driver 30 is controlled by the control device to drive the spray rod 20 to rotate into the initial position from the current position, it is necessary for the system to calculate a duration required for the motor 31 to drive the spray rod to rotate into the initial position from the current position.

In this embodiment, when the motor 31 is a unidirectional rotary motor, the shaft of the motor 31 is only rotatable in one direction (clockwise or counterclockwise). That is, the motor 31 can only drive the spray rod 20 to rotate towards the initial position from the current position in one direction. Therefore, the motor 31 can be accurately controlled by calculating the duration required for the motor 31 to drive the spray rod 20 to rotate into the initial position from the current position in one direction.

When the motor is a bidirectional rotary motor, the shaft of the motor is rotatable clockwise or counterclockwise.

Therefore, the rotation direction of the motor can be controlled by calculating a shortest duration required for the motor to drive the spray rod to rotate into the initial position from the current position. Therefore, the predetermined washing is performed on the tableware in the predetermined washing region while improving the washing efficiency. In this way, the washing efficiency and the washing effect can be improved.

In some other embodiments, the spray rod driver 30 includes a motor 31, and the motor 31 is a bidirectional rotary motor. Before the spray rod driver 30 is controlled by the control device to drive the spray rod 20 to rotate into the initial position from the current position, it is necessary for the system to detect an angle between the current position and the initial position in a first rotation direction. In response to determining that the angle is greater than 180°, a duration required for the motor 31 to drive the spray rod 20 to rotate into the initial position from the current position in a second rotation direction opposite to the first rotation direction is calculated. In response to determining that the angle is smaller than or equal to 180°, a duration required for the motor 31 to drive the spray rod 20 to rotate into the initial position from the current position in the first rotation direction is calculated.

The first rotation direction herein may be the clockwise direction, and the second rotation direction is the counterclockwise direction correspondingly. The first rotation direction may also be the counterclockwise direction, and the second rotation direction is the clockwise direction correspondingly.

In some embodiments, the motor 31 is the bidirectional rotary motor, i.e., the shaft of the motor 31 is rotatable clockwise or counterclockwise. Thus, in order to improve the operating efficiency and reduce the duration required for the spray rod 20 to rotate into the initial position, before the spray rod 20 is driven by the motor 31 to directly rotate into the initial position from the current position, the angle between the current position where the spray rod is located and the initial position in the first rotation direction can be detected first to determine the rotation direction of the spray rod 20 based on the detection, and then the shortest duration required for the motor 31 to drive the spray rod 20 to rotate towards the initial position is calculated. In this way, the accurate control can be realized.

As shown in FIG. 4 and FIG. 5, in some embodiments, the spray rod driver 30 includes a motor 31 and a transmission mechanism 32. The spray rod 20 is in transmission connection to a shaft of the motor 31 through the transmission mechanism 32. The transmission mechanism 32 herein may be a gear transmission mechanism or a belt transmission mechanism.

Further, the dishwasher 100 also includes a calculation device. The calculation device is configured to calculate, based on the actual time required for the motor 31 to rotate through one revolution, a duration required for the spray rod 20 to rotate into the predetermined washing region from the initial position.

In this embodiment, a transmission ratio between the shaft of the motor 31 and the spray rod 20 is known. That is, a transmission ratio of the transmission mechanism 32 is known. The calculation device can calculate, based on the actual duration required for the motor 31 to rotate through one revolution, the duration required for the spray rod 20 to rotate through one revolution, and then calculate, based on a relative relationship between the predetermined washing region and the initial position, the duration required for the spray rod 20 to rotate into the predetermined washing region from the initial position i.e., the duration required for the motor 31 to operate when the spray rod 20 rotates into the predetermined washing region from the initial position.

In some embodiments, the duration t required for the spray rod 20 to rotate into the predetermined washing region from the initial position is $TN\alpha/360$, where T represents the actual duration required for the motor 31 to rotate through one revolution, a represents an angle between the predetermined washing region and the initial position, and N represents the transmission ratio of the transmission mechanism 32.

For example, when the transmission ratio of the transmission mechanism 32 is 1:1, the actual duration required for the motor 31 to rotate through one revolution is the duration required for the spray rod 20 to rotate through one revolution, and the duration t required for the spray rod 20 to rotate into the predetermined washing region from the initial position is $TN\alpha/360$.

In some embodiments, the calculation device is further configured to calculate a rotation duration of the spray rod 20 in the predetermined region to maintain the spray rod 20 at the adjusted parameter of the fluid flow within the rotation duration.

In this embodiment, an angle between a connecting line between one of the two boundary lines of the predetermined washing region and a center of an inner tub 10 and a connecting line between the other one of the two boundary lines of the predetermined washing region and the center of the inner tub 10 is $\beta-\alpha$, where $\alpha$ is an angle between one of the two boundary lines of the predetermined washing region and the initial position, and $\beta$ is an angle between the other one of the two boundary lines of the predetermined washing region and the initial position. The rotation duration of the spray rod 20 in the predetermined washing region can be calculated as $T(\beta-\alpha)/360$ based on the above formula. Therefore, the washing pump is controlled to maintain the fluid flow pressure in the time period, and recover the initial fluid flow parameter beyond the time period. Thus, the predetermined washing can be performed on the tableware in the predetermined washing region.

In some embodiments, the dishwasher 100 further includes a position detection device 40. The position detection device 40 is in communication with the control device. The position detection device 40 is configured to detect a position signal of the motor 31 within the predetermined time period.

The calculation device is further configured to obtain the actual duration required for the shaft of the motor to rotate through one revolution by calculating an interval time between receptions of two same predetermined position signals of the motor 31 within the predetermined time period and a revolution number of the shaft of the motor within the interval time. The predetermined time period is greater than or equal to a rated duration required for the shaft of the motor 31 to rotate through two revolutions.

Figure 7:
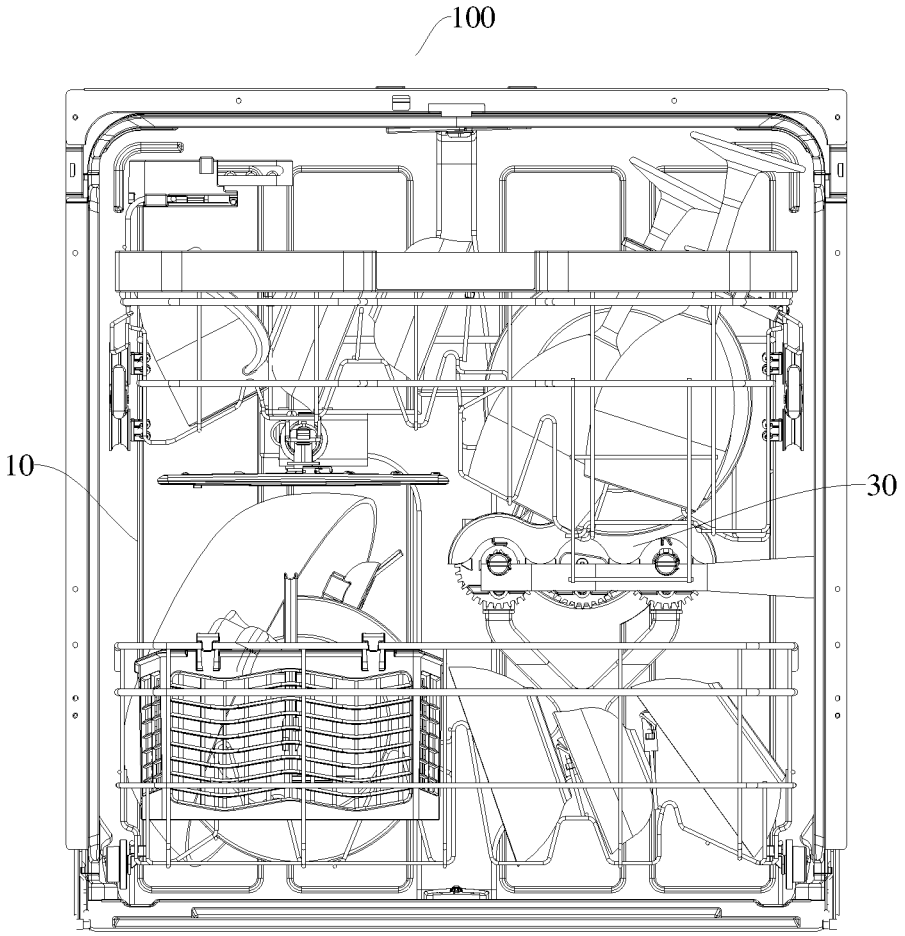
FIG. 7 is a schematic structural view of a dishwasher according to embodiments of the present disclosure.
Figure 8:
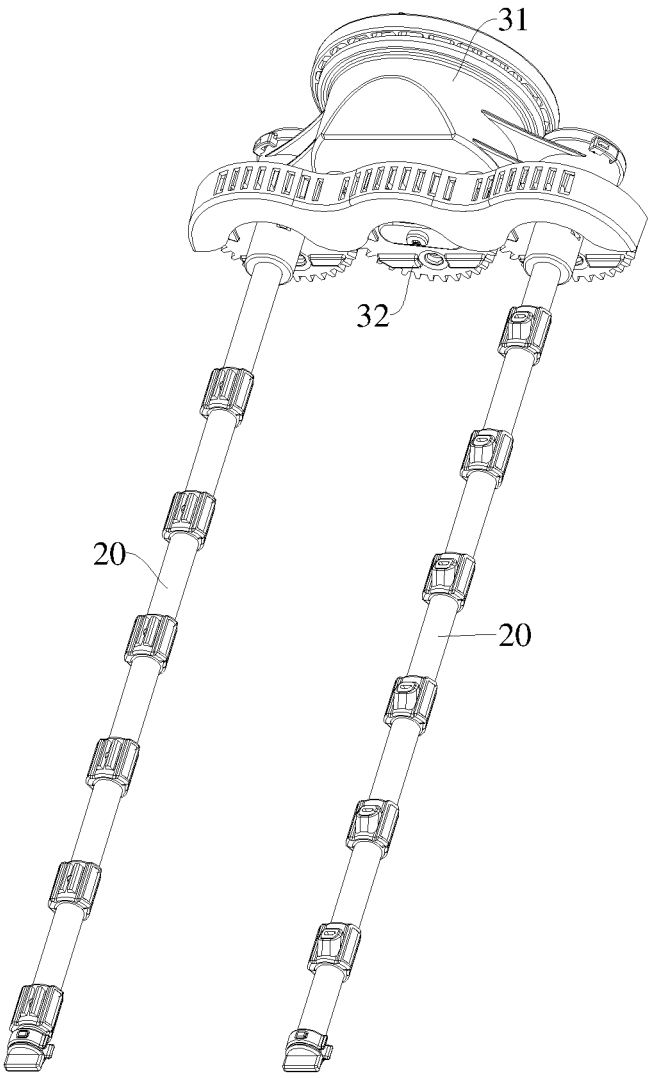
FIG. 8 is an assembly diagram of a spray rod and a spray rod driver of a dishwasher according to embodiments of the present disclosure.
Figure 9:
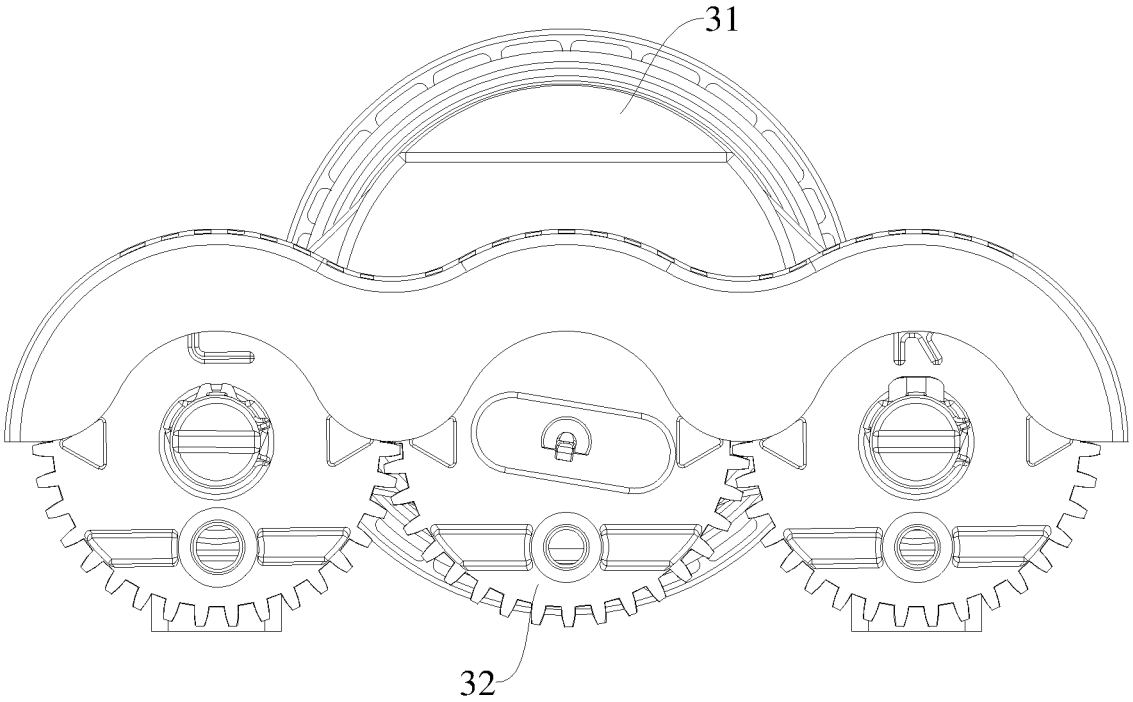
FIG. 9 is a schematic structural view of a spray rod driver of a dishwasher according to embodiments of the present disclosure.
Figure 10:
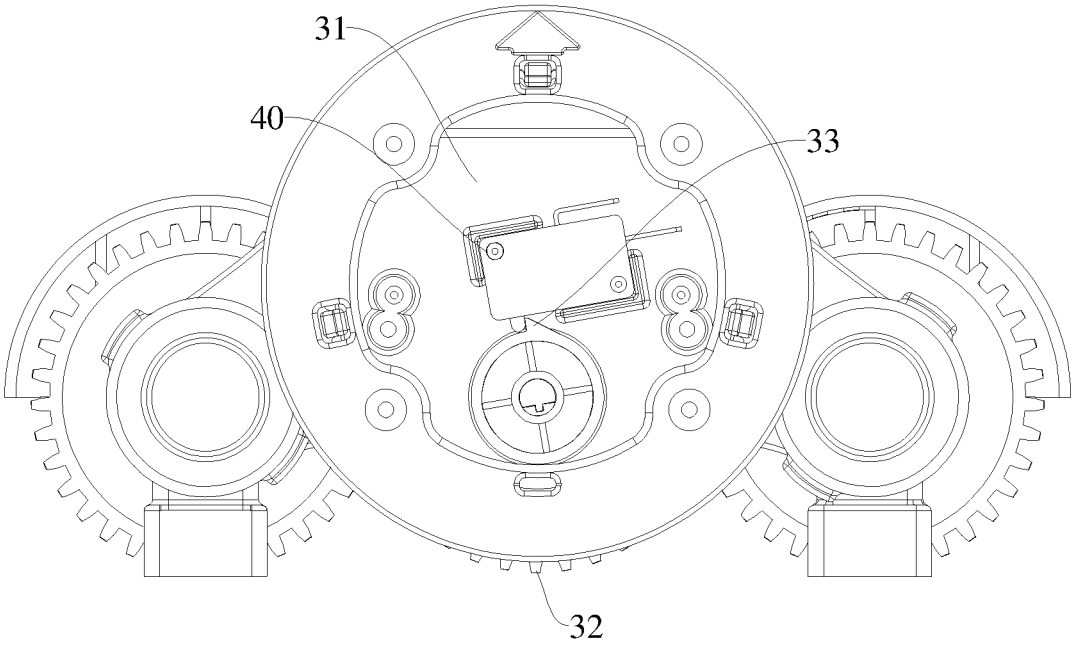
FIG. 10 is another schematic structural view of a spray rod driver of a dishwasher according to embodiments of the present disclosure.

As illustrated in FIG. 5 to FIG. 7, the position detection device 40 is a micro switch. At least one protrusion 33 is disposed on a peripheral wall of a camshaft connected to the motor 31. Each of the at least one protrusion 33 is adapted to be engaged with the micro switch, and the micro switch is adapted to transmit the position signal when the micro switch is in contact with the protrusion 33.

It can be understood that, during the rotation of the motor 31, every time the motor 31 rotates through one revolution, the protrusion 33 on the camshaft is in contact with the micro switch to trigger the micro switch to transmit the position signal.

When one protrusion 33 is provided on the camshaft, every time the motor 31 rotates through one revolution, the micro switch is in contact with the protrusion 33 one time to trigger the micro switch to transmit the position signal. In this case, only the interval time between receptions of the two adjacent position signals needs to be calculated. When a plurality of protrusions 33 (two or more) are provided on the camshaft, every time the motor 31 rotates through one revolution, the micro switch is intermittently in contact with the plurality of protrusions 33 to trigger the micro switch to transmit a plurality of position signals. In this case, the plurality of position signals is identified, and the interval time between receptions of the two same adjacent position signals is recorded.

In some other embodiments, the spray rod driver includes a motor. The motor is a bidirectional rotary motor. Before the spray rod driver is controlled by the control device to drive the spray rod to rotate into the predetermined washing region from the initial position, it is necessary for the system to detect the angle between the initial position and each of two boundary lines of the predetermined washing region, and then a duration required for the motor to drive the spray rod to rotate from the initial position to a closer one of the two boundary lines to the spray rod is calculated based on the detection, to control the motor to drive the spray rod to rotate towards the closer one of the two boundary lines to the spray rod from the initial position.

In this embodiment, the motor is the bidirectional rotary motor, i.e., the shaft of the motor is rotatable clockwise or counterclockwise. Thus, in order to improve the operating efficiency and reduce the duration required for the spray rod to rotate into the predetermined washing region, before the spray rod is driven by the motor to directly rotate into the predetermined washing region from the initial position, the angle between the initial position and each of two boundary lines of the predetermined washing region can be detected first to determine the closer one of the two boundary lines to the spray rod, and then the duration required for the motor to drive the spray rod to rotate towards the closer one of the two boundary lines to the spray rod is calculated based on the determination to achieve the accurate control.

In the description of the present disclosure, it is to be understood that, terms such as "center", "longitudinal", "lateral", "length", "width", "thickness", "over", "below", "front", "back", "left", "right", "vertical", "horizontal", "top", "bottom", "in", "out", "clockwise", "counterclockwise", "axial", "radial", "circumferential", etc., is based on the orientation or position relationship shown in the drawings, and is only for the convenience of describing the present disclosure and simplifying the description, rather than indicating or implying that the associated device or element must have a specific orientation, or be constructed and operated in a specific orientation, and therefore cannot be understood as a limitation on the present disclosure.

According to the embodiments of the present disclosure, other compositions and operations of the dishwasher are known to those of ordinary skill in the art, and details thereof will be omitted herein.

In the description of this specification, descriptions with reference to the terms "an embodiment", "some embodiments", "an exemplary embodiment", "an example", "a specific example", or "some examples" etc., mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although embodiments of the present disclosure have been illustrated and described, it is conceivable for those of ordinary skill in the art that various changes, modifications, replacements, and variations can be made to these embodiments without departing from the principles and spirit of the present disclosure. The scope of the present disclosure shall be defined by the claims as appended and their equivalents.

What is claimed is:

1. A control method for a dishwasher, the dishwasher comprising:

a spray rod; and a spray rod driver, wherein:

the spray rod driver comprises a motor and a transmission mechanism, the spray rod being in transmission connection to a shaft of the motor through the transmission mechanism; and the spray rod driver is configured to drive the spray rod to rotate;

the control method comprising:

acquiring a predetermined washing signal;

controlling the spray rod driver to drive the spray rod to rotate into an initial position from a current position;

acquiring an actual duration required for the motor to rotate through one revolution;

calculating, based on the actual duration required for the motor to rotate through one revolution, a duration required for the spray rod to rotate into a predetermined washing region from the initial position;

controlling the spray rod driver to drive the spray rod to rotate into the predetermined washing region from the initial position based on the calculated duration; and adjusting a parameter of fluid flow to be sprayed when the spray rod rotates into the predetermined washing region.

2. The control method for the dishwasher according to claim 1, further comprising, prior to said controlling the spray rod driver to drive the spray rod to rotate into the initial position from the current position:

calculating a duration required for the spray rod driver to drive the spray rod to rotate into the initial position from the current position.

3. The control method for the dishwasher according to claim 1, wherein:

the motor is a bidirectional rotary motor; and the method further comprises, prior to said controlling the spray rod driver to drive the spray rod to rotate into the initial position from the current position:

detecting an angle between the current position and the initial position in a first rotation direction;

calculating, in response to detecting that the angle is greater than 180°, a duration required for the motor to drive the spray rod to rotate into the initial position from the current position in a second rotation direction opposite to the first rotation direction; and calculating, in response to detecting that the angle is smaller than or equal to 1800, a duration required for the motor to drive the spray rod to rotate into the initial position from the current position in the first rotation direction.

4. The control method for the dishwasher according to claim 1, wherein the duration required for the spray rod to rotate into the predetermined washing region from the initial position is $TN\alpha/360$, where:

T represents the actual duration required for the motor to rotate through one revolution;

$\alpha$ represents an angle between the predetermined washing region and the initial position; and N represents a transmission ratio of the transmission mechanism.

5. The control method for the dishwasher according to claim 1, wherein said acquiring the actual duration required for the motor to rotate through one revolution comprises:

detecting a position signal of the motor within a predetermined time period; and obtaining the actual duration required for the shaft of the motor to rotate through one revolution by calculating an interval time between receptions of two same predetermined position signals of the motor within the predetermined time period and a revolution number of the shaft of the motor within the interval time, the predetermined time period being greater than or equal to a rated duration required for the shaft of the motor to rotate through two revolutions.

6. The control method for the dishwasher according to claim 1, further comprising:

controlling the spray rod driver to drive the spray rod to rotate back and forth or intermittently within a predetermined angle range in the predetermined washing region.

7. The control method for the dishwasher according to claim 1, further comprising, prior to said controlling the spray rod driver to drive the spray rod to rotate into the predetermined washing region from the initial position:

calculating a rotation duration of the spray rod in the predetermined washing region to maintain the spray rod at the adjusted parameter of the fluid flow within the rotation duration.

8. The control method for the dishwasher according to claim 1, wherein said adjusting the parameter of the fluid flow to be sprayed when the spray rod rotates into the predetermined washing region comprises:

increasing or decreasing the parameter of the fluid flow to be sprayed from the spray rod.

* * * * *